US008998520B1

(12) United States Patent
Tanner

(10) Patent No.: US 8,998,520 B1
(45) Date of Patent: Apr. 7, 2015

(54) MAKEUP APPLICATOR ASSEMBLY

(71) Applicant: Beryl L. Tanner, Kitchener (CA)

(72) Inventor: Beryl L. Tanner, Kitchener (CA)

( * ) Notice: Subject to any disclaimer, the term of this patent is extended or adjusted under 35 U.S.C. 154(b) by 290 days.

(21) Appl. No.: 13/653,541

(22) Filed: Oct. 17, 2012

(51) Int. Cl.
*B43K 5/16* (2006.01)
*A45D 40/26* (2006.01)

(52) U.S. Cl.
CPC ..... *A45D 40/264* (2013.01); *A45D 40/262* (2013.01)

(58) Field of Classification Search
USPC ..... 401/99, 101, 104, 107, 109, 195
See application file for complete search history.

(56) References Cited

U.S. PATENT DOCUMENTS

| | | | | |
|---|---|---|---|---|
| 4,927,282 | A * | 5/1990 | Morane et al. | 401/129 |
| 5,951,185 | A * | 9/1999 | Kingsford et al. | 401/99 |
| 6,371,129 | B1 * | 4/2002 | Le Bras-Brown et al. | 132/218 |
| 6,497,235 | B2 | 12/2002 | Dorsa et al. | |
| 7,100,247 | B2 * | 9/2006 | Fujihara et al. | 24/11 R |
| D598,655 | S | 8/2009 | Thorpe et al. | |
| 7,651,288 | B2 | 1/2010 | Welschoff | |
| 7,841,794 | B2 | 11/2010 | Salciarini et al. | |
| 8,287,199 | B2 * | 10/2012 | Salciarini et al. | 401/109 |
| 8,292,529 | B2 * | 10/2012 | Francavilla | 401/101 |
| 2004/0184865 | A1 | 9/2004 | Carroll | |
| 2009/0097899 | A1 * | 4/2009 | Carroll | 401/109 |
| 2009/0232578 | A1 | 9/2009 | Grossnass et al. | |
| 2010/0065080 | A1 | 3/2010 | Wynne | |
| 2010/0139686 | A1 | 6/2010 | Legassie et al. | |
| 2010/0236567 | A1 * | 9/2010 | Carroll et al. | 132/200 |
| 2011/0116857 | A1 | 5/2011 | Carroll et al. | |

* cited by examiner

*Primary Examiner* — Jennifer C Chiang

(57) ABSTRACT

A makeup applicator assembly includes an elongated tube having an interior space, a bottom end and a top end. A bottom opening extends through the bottom end of the tube. A chamber is positioned in the interior space and the chamber is positioned proximate the bottom end of the tube. A makeup material is positioned in the chamber. An elongated applicator is also positioned in the chamber. A button is coupled to and extends from the top end of the tube. A plunger extends between the button and the applicator, and the plunger also extends into the chamber. A dispensing aperture is positioned in the chamber. The applicator is extendable through the dispensing aperture. The dispensing aperture is positioned proximate the bottom end of the tube wherein the applicator is extendable from the bottom end of the tube when the button is manipulated.

6 Claims, 3 Drawing Sheets

MAKEUP APPLICATOR ASSEMBLY

BACKGROUND OF THE DISCLOSURE

Field of the Disclosure

The disclosure relates to makeup application devices and more particularly pertains to a new makeup application device for facilitating application of makeup using one hand.

SUMMARY OF THE DISCLOSURE

An embodiment of the disclosure meets the needs presented above by generally comprising an elongated tube having an interior space, a bottom end and a top end. A bottom opening extends through the bottom end of the tube. A chamber is positioned in the interior space and the chamber is positioned proximate the bottom end of the tube. A makeup material is positioned in the chamber. An elongated applicator is also positioned in the chamber. A button is coupled to and extends from the top end of the tube. A plunger extends between the button and the applicator, and the plunger also extends into the chamber. A dispensing aperture is positioned in the chamber. The applicator is extendable through the dispensing aperture. The dispensing aperture is positioned proximate the bottom end of the tube wherein the applicator is extendable from the bottom end of the tube when the button is manipulated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
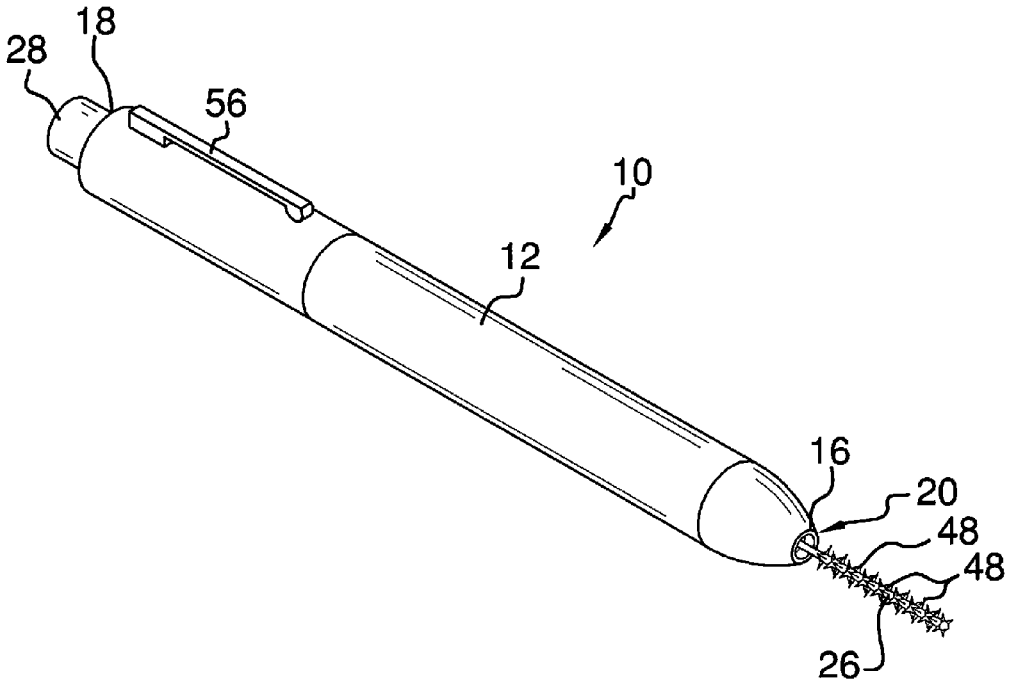
FIG. 1 is a bottom front side perspective view of a makeup applicator assembly according to an embodiment of the disclosure.
Figure 2:
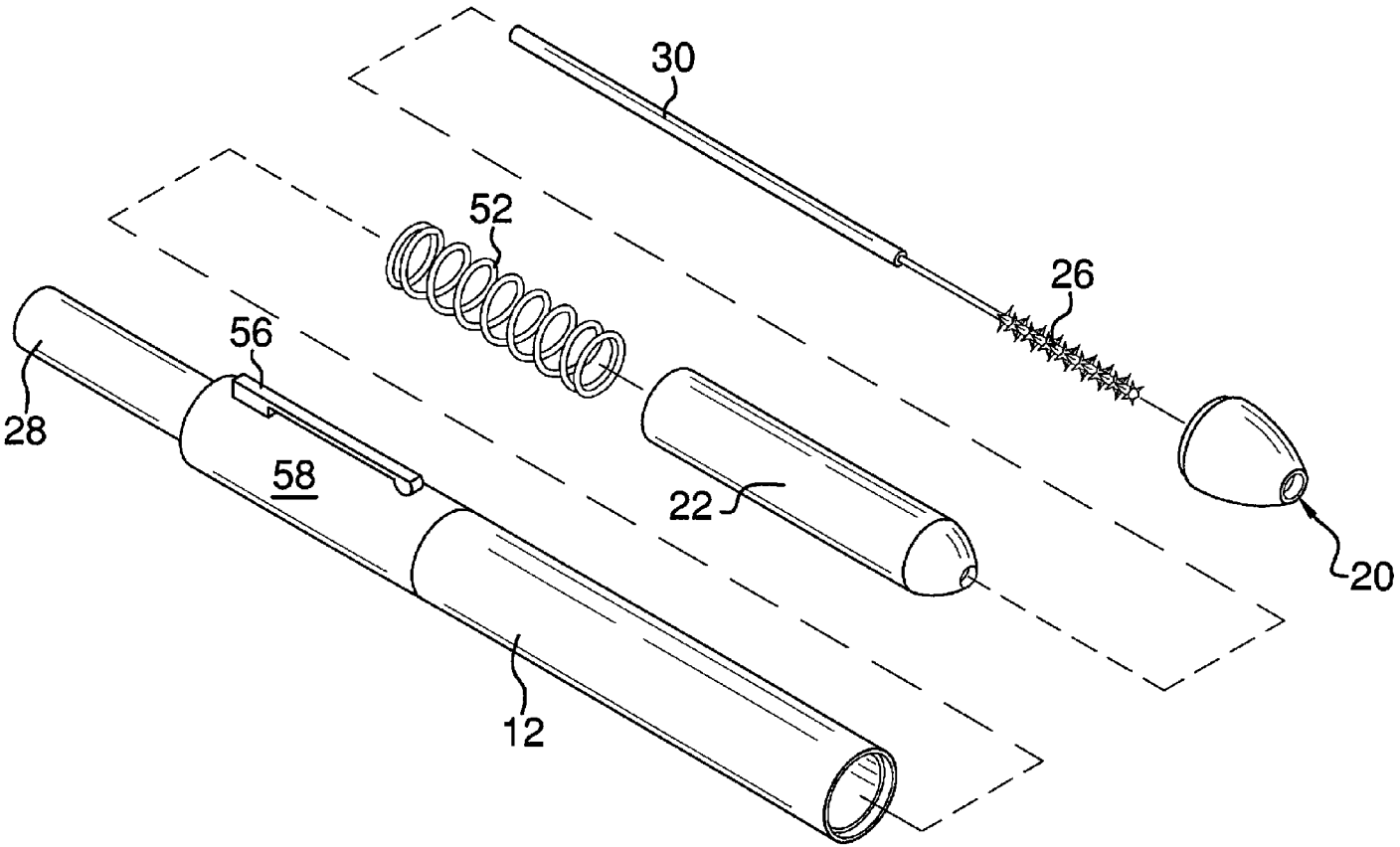
FIG. 2 is an exploded bottom front side perspective view of an embodiment of the disclosure.
Figure 3:
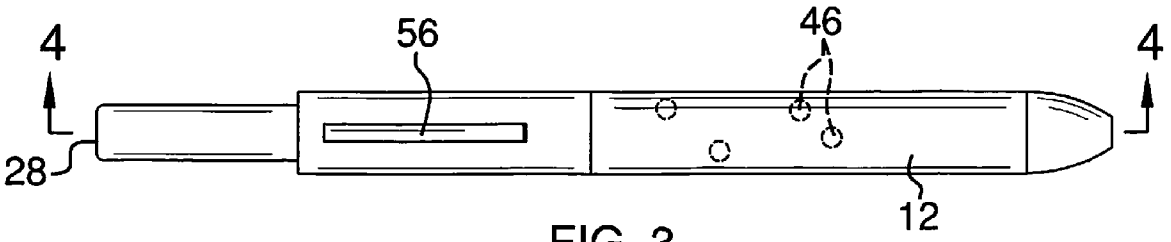
FIG. 3 is a top view of an embodiment of the disclosure.
Figure 4:
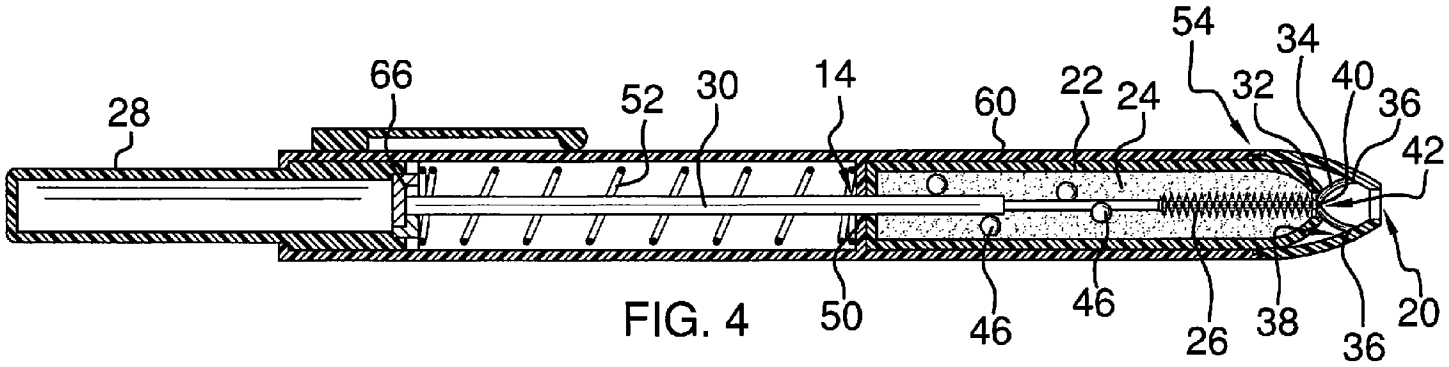
FIG. 4 is a cross-sectional view of an embodiment of the disclosure taken along line 4-4 of FIG. 3.
Figure 5:
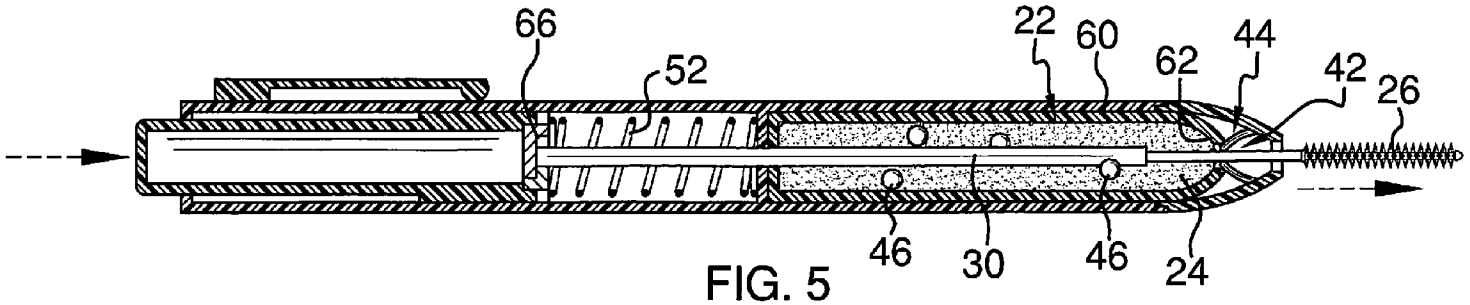
FIG. 5 is a cross-sectional view of an embodiment of the disclosure similar to FIG. 4 but showing an extended position.

With reference now to the drawings, and in particular to FIGS. 1 through 5 thereof, a new makeup applicator assembly embodying the principles and concepts of an embodiment of the disclosure and generally designated by the reference numeral 10 will be described.

As best illustrated in FIGS. 1 through 5, the makeup applicator assembly 10 generally comprises an elongated tube 12 having an interior space 14, a bottom end 16 and a top end 18. A bottom opening 20 extends through the bottom end 16 of the tube 12. A chamber 22 is positioned in the interior space 14. The chamber 22 is positioned proximate the bottom end 16 of the tube 12. A makeup material 24 is positioned in the chamber 22, with an elongated applicator 26 also being positioned in the chamber 22. A button 28 is coupled to and extends from the top end 18 of the tube 12. A plunger 30 extends between the button 28 and the applicator 26. The plunger 30 may also extends into the chamber 22.

A dispensing aperture 32 is positioned in the chamber 22. The applicator 26 is extendable through the dispensing aperture 32. The dispensing aperture 32 is positioned proximate the bottom end 16 of the tube 12 wherein the applicator 26 is extendable from the bottom end 16 of the tube 12 when the button 28 is manipulated. A seal 34 is coupled to the chamber 22 and the seal 34 covers the dispensing aperture 32. The applicator 26 is selectively extendable through the seal 34. The seal 34 has an outer perimeter 36 coupled to an interior surface 38 of the tube 12. The seal 34 has an inner perimeter 40 defining a central orifice 42 through which the applicator 26 extends and retracts. The seal 34 has a parabolic diametric cross-sectional shape 44. A plurality of balls 46 may be positioned in the chamber 22 wherein the balls 46 agitate the makeup 24 within the chamber 22 when the chamber 22 is shaken. A plurality of bristles 48 is coupled to and extends radially from the applicator 26. An interior wall 50 is statically positioned in the tube 12 proximate the chamber 22. The plunger 30 extends through the interior wall 50. A biasing member 52 is positioned in the tube 12 and abuts the interior wall 50. The biasing member 52 is coupled to the button 28 wherein the biasing member 52 urges the button 28 outwardly through the top end 18 of the tube 12 and the applicator 26 into a retracted position 54. The mechanism 66 may work in the same fashion as extension and retraction mechanisms commonly used in a writing implement.

A clip 56 is coupled to an exterior surface 58 of the tube 12. A perimeter wall 60 defining the chamber 22 is positioned in the tube 12. An end 62 of the perimeter wall 60 curves inwardly approaching the dispensing aperture 32.

In use, the button 28 is manipulated to actuate the plunger 30 extending the applicator 26. Makeup material 24 from the chamber 22 is held on the bristles 48 to be applied to a person such as on the eyelashes or another desired body part. The balls 46 may be agitated within the chamber 22 prior to extension of the applicator 26. The applicator 26 is retracted back into the chamber 22 by further manipulation of the button 28. The seal 34 holds the makeup material 24 within the chamber 22 allowing the assembly 10 to be stored in a desired location until needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A makeup applicator assembly comprising:

an elongated tube having an interior space, a bottom end and a top end;

a bottom opening extending through said bottom end of said tube;

a chamber positioned in said interior space, said chamber being positioned proximate said bottom end of said tube;

makeup positioned in said chamber;

an elongated applicator positioned in said chamber;

a button coupled to and extending from said top end of said tube;

a plunger extending between said button and said applicator, said plunger extending into said chamber;

a dispensing aperture positioned in said chamber, said applicator being extendable through said dispensing aperture, said dispensing aperture being positioned proximate said bottom end of said tube wherein said applicator is extendable from said bottom end of said tube when said button is manipulated;

a seal coupled to said chamber, said seal covering said dispensing aperture, said applicator being selectively extendable through said seal said seal having an outer perimeter coupled to an interior surface of said tube, said seal having an inner perimeter defining a central orifice through which said applicator extends and retracts, said seal having a parabolic diametric cross-sectional shape; and a perimeter wall defining said chamber being positioned in said tube, an end of said perimeter wall curving inwardly approaching said dispensing aperture.

2. The assembly of claim 1, further comprising a plurality of balls positioned in said chamber wherein said balls agitate said makeup within said chamber when said chamber is shaken.

3. The assembly of claim 1, further comprising a plurality of bristles coupled to and extending radially from said applicator.

4. The assembly of claim 1, further comprising:

an interior wall statically positioned in said tube proximate said chamber, said plunger extending through said interior wall; and a biasing member positioned in said tube, said biasing member abutting said interior wall and being coupled to said button wherein said biasing member urges said button outwardly through said top end of said tube and said applicator into a retracted position.

5. The assembly of claim 1, further comprising a clip coupled to an exterior surface of said tube.

6. A makeup applicator assembly comprising:

an elongated tube having an interior space, a bottom end and a top end;

a bottom opening extending through said bottom end of said tube;

a chamber positioned in said interior space, said chamber being positioned proximate said bottom end of said tube;

makeup positioned in said chamber;

an elongated applicator positioned in said chamber;

a button coupled to and extending from said top end of said tube;

a plunger extending between said button and said applicator, said plunger extending into said chamber;

a dispensing aperture positioned in said chamber, said applicator being extendable through said dispensing aperture, said dispensing aperture being positioned proximate said bottom end of said tube wherein said applicator is extendable from said bottom end of said tube when said button is manipulated;

a seal coupled to said chamber, said seal covering said dispensing aperture, said applicator being selectively extendable through said seal, said seal having an outer perimeter coupled to an interior surface of said tube, said seal having an inner perimeter defining a central orifice through which said applicator extends and retracts, said seal having a parabolic diametric cross-sectional shape;

a plurality of balls positioned in said chamber wherein said balls agitate said makeup within said chamber when said chamber is shaken;

a plurality of bristles coupled to and extending radially from said applicator;

an interior wall statically positioned in said tube proximate said chamber, said plunger extending through said interior wall;

a biasing member positioned in said tube, said biasing member abutting said interior wall and being coupled to said button wherein said biasing member urges said button outwardly through said top end of said tube and said applicator into a retracted position;

a clip coupled to an exterior surface of said tube; and a perimeter wall defining said chamber being positioned in said tube, an end of said perimeter wall curving inwardly approaching said dispensing aperture.

* * * * *